US005282873A

United States Patent [19]

Watari

[11] Patent Number: 5,282,873

[45] Date of Patent: Feb. 1, 1994

[54] ARTIFICIAL GROUND

[76] Inventor: Sigenobu Watari, 868-77, Imasato, Kawanakajima-machi, Nagano-shi, Nagano 381-22, Japan

[21] Appl. No.: 983,612

[22] Filed: Nov. 30, 1992

Related U.S. Application Data

[63] Continuation of Ser. No. 653,966, Feb. 12, 1991, abandoned.

[30] Foreign Application Priority Data

May 18, 1990 [JP] Japan ..... 2-129860

[51] Int. Cl.[5] ..... A23K 1/00; A01G 31/00

[52] U.S. Cl. ..... 47/1.01; 47/66

[58] Field of Search ..... 47/59, 48.5, 79, 27, 47/66 X, 1.01 OR, 62, 63, 64, 82, 83

[56] References Cited

U.S. PATENT DOCUMENTS

| | | | |
|---|---|---|---|
| 3,451,162 | 6/1969 | Rasmussen | 47/79 |
| 3,925,926 | 12/1975 | Shigeo | 47/62 |
| 4,038,779 | 8/1977 | Roberts, Jr. et al. | 47/64 |
| 4,189,867 | 2/1980 | Schneck | 47/79 |
| 4,290,229 | 9/1981 | Miura | 47/79 |
| 4,833,825 | 5/1989 | Sprung | 47/62 |
| 5,000,976 | 3/1991 | Odaira | 71/5 |
| 5,010,686 | 4/1991 | Rivest | 47/62 |

FOREIGN PATENT DOCUMENTS

| | | | |
|---|---|---|---|
| 63-28331 | 2/1988 | Japan . | |
| 1-120226 | 5/1989 | Japan . | |
| 8202642 | 8/1982 | PCT Int'l Appl. | 47/59 |

OTHER PUBLICATIONS

*Turf Management for Golf Courses,* Beard 1982 pp. 110–113.

Popular Science Monthly, (47/59) vol. 134 No. 4 pp. 144–147 Apr. 1939.

*Primary Examiner*—Carl D. Friedman
*Assistant Examiner*—Wynn Wood
*Attorney, Agent, or Firm*—Birch, Stewart, Kolasch & Birch

[57] ABSTRACT

An artificial ground system can be utilized in a green of a golf course or for ground unsuitable for cultivation. The artificial ground includes a collection layer having an inclined sheet member capable of collecting liquid agricultural chemicals or water, a soil supporting layer having a water-permeable soil supporting member disposed on the collection layer, and an artificial soil layer having artificial soil disposed on the soil supporting layer. For example, the artificial soil contains as a main component the remainder of fermentation material which is subjected to at least a controlled amount of water and combined with at least one or two additives required for soil constitution.

22 Claims, 2 Drawing Sheets

ARTIFICIAL GROUND

This application is a continuation of application Ser. No. 07/653,966 filed on Feb. 12, 1991, now abandoned.

BACKGROUND OF THE INVENTION

1. Field of the Invention

The present invention relates to artificial ground suitable for use in a golf course, ground unsuitable for cultivation and the like.

2. Description of Related Art

Heretofore, in a place such as a golf course where a large quantity of water is used for greens or fairways, water is intensively controlled. For example, Japanese Patent Unexamined Patent Publication Nos. 63-28331 and 1-120226 disclose a method in which a waterproof sheet is spread under the ground on which the green is planted and water penetrating through the green is collected by the sheet for re-utilization. In this manner, security and effective utilization of the water source is an important subject in the golf course.

On the other hand, there is a danger that scattering of agricultural chemicals for extermination of diseases and noxious insects will seriously contaminate the environment. Agricultural chemicals scattered onto a green in a golf course are caused to be mixed into a reservoir for city water together with rainwater, and the drinking water may be contaminated. Thus, contamination of the environment by agricultural chemicals is a large social problem and it is desired that the dispersion of agricultural chemicals be minimized.

However, since there are many plant diseases and noxious insects (cockroaches, ticks, nematodes and the like) which are media for viruses in a golf course using natural soil, extermination of diseases and noxious insects by agricultural chemicals is avoided and there is no guarantee that contamination of the environment can be suppressed completely. Further, the natural soil can not increase the amount of water collected, that is, the collection efficiency, because of the penetration by the water sufficiently and, accordingly, the practicality of water collection is lacking.

SUMMARY OF THE INVENTION

It is an object of the present invention to provide an artificial ground in which there is less virus such that the amount of agricultural chemicals to be used can be remarkably reduced so that contamination of the environment due to dispersed agricultural chemicals can be prevented adequately and the contamination problem with respect to the environment of a golf course can be solved.

Further, it is another object of the present invention to provide artificial ground in which the penetration of water is enhanced greatly and the collection efficiency of water is remarkably increased so as to improve effective utilization of a water source.

Furthermore, it is a further object of the present invention to provide artificial ground which can be applied to other fields for cultivating plants even in ground unsuitable for cultivation and to increase the kinds of cultivatable plants to attain the cultivation of good quality plants, reduction of food pollution and a long life for the plants due to the reduction of agricultural chemicals.

In order to achieve the objects, the artificial ground of the present invention comprises a collection layer C1 including an inclined sheet member 2 capable of collecting liquid agricultural chemicals W1 or water W2, a soil supporting layer C2 including a soil supporting and water-penetrative member 3 disposed on the collection layer C1, and an artificial soil layer C3 including artificial soil 4 disposed on the soil supporting layer C2, and is used for lawn ground 10 in a golf course. Further, the artificial soil 4 desirably includes artificial soil containing a remainder of fermentation material having at least a controlled amount of water as a main component and combined with at least one or two additives required for soil, the artificial soil containing pulverized seed husks as a main component and combined with at least one or two additives required for soil, and the artificial soil containing sawdust as a main component and combined with at least one or two additives required for soil.

With such an artificial ground 1, a virus-free green for the golf course is attained and the amount of necessary agricultural chemicals is reduced greatly. Further, the artificial ground 1 comprises the three layers of the artificial soil layer C3, the soil supporting layer C2 and the collection layer C1 from the upper side. Accordingly, when liquid agricultural chemicals W1 or water W2 are dispersed on the surface of the artificial soil 4, the liquid agricultural chemicals W1 or water W2 are dispersed on the surface of the artificial soil 4, the liquid agricultural chemicals W1 or water W2 penetrate into the artificial soil layer C3 and then reach the collection layer C1 having the inclined sheet member 2 through the water-penetrative soil supporting layer C2 so that the liquid agricultural chemicals or water are all collected. Consequently, the liquid agricultural chemicals W1 or water W2 are subjected to necessary filtration and are discarded. Further, the liquid agricultural chemicals W1 or water W2 can be re-used.

In this case, since an upper portion and lower portion are separated by the sheet member 2, the liquid agricultural chemicals can be prevented from penetrating into the lower portion through the sheet member 2 so that contamination of the environment can be prevented. Further, penetration of viruses into the upper portion through the sheet member 2 can be prevented so that the artificial soil 4 can be maintained virus-free for a long time.

Further, since the artificial soil 4 allows for an extremely large penetration of water, the collection rate of water and liquid agricultural chemicals is increased greatly to thereby ensure effective utilization of the water source in the golf course and prevent contamination of the environment due to reduced liquid agricultural chemicals.

DETAILED DESCRIPTION OF THE PREFERRED EMBODIMENTS

A preferred embodiment according to the present invention is now described in detail with reference to the drawings.

Construction of the artificial ground according to the present invention is now described with reference to FIG. 1.

Figure 1:
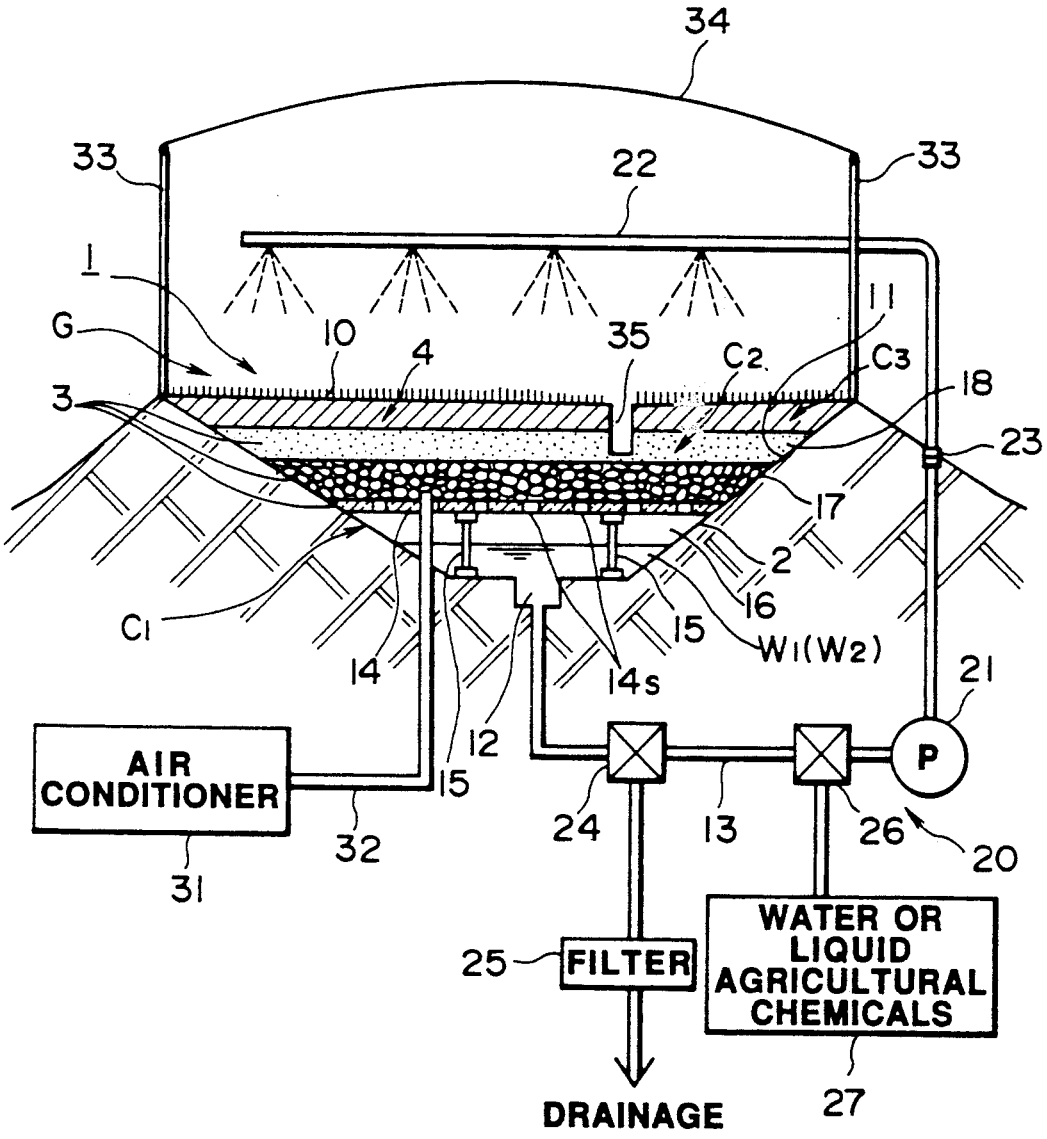
FIG. 1 is a section view of artificial ground according to the present invention which is applied to a golf course.

The embodiment shown in FIG. 1 illustrates the artificial ground applied to green G in a golf course.

A conical cavity 11 for forming a concave inclined surface is formed under the green G and a sheet member 2 is spread on the whole surface of the cavity 11. The sheet member 2 utilizes a relatively thick watertight sheet of, for example, vinyl chloride. Further, a drainage hole 12 is formed in a lowermost portion positioned in a substantially central portion of the sheet member 2 and a circular pipe 13 is connected to the drainage hole 12. The sheet member 2 constitutes a collection layer C1.

On the other hand, disposed in an intermediate position of the cavity 11 is a water-permeable plate member 14 formed with a plurality of small holes 14s. The plate member 14 is supported at predetermined positions by a plurality of posts 15. The plate member can be made of any material such as concrete, metal, wood and plastic. Thus, a reservoir space 16 can be formed under the plate member 14. Further, relatively large gravel 17 is spread on the plate member 14 and sand 18 is further spread on the gravel. The plate member 14, the gravel 17 and the sand 18 constitute a soil supporting material 3 and further constitute a soil supporting layer C2 having water-permeable properties. The gravel 17 and the sand 18 are previously heated for sterilization. The soil supporting member 3 may use brick or block.

Artificial soil 4 is spread on the soil supporting layer C2 to constitute an artificial soil layer C3.

The artificial soil 4 can be artificial soil disclosed in Japanese Unexamined Patent Publication No. 2-46228 proposed by the present applicant.

Generally a large amount of remainder of fermentation material is produced in the brewing industry. Such a remainder is utilized as a main component of the culture ground for mushrooms. The reason why the remainder produced during the manufacturing of alcohol is not used as a soil component directly and the culture ground for mushrooms is manufactured intermediately is that re-fermentation (decomposition) of the remainder is accelerated to improve physical, chemical and biophysical properties of the soil and to attain applicability for cultivation of the mushroom itself and enhance the value added. Accordingly, the remainder produced using the manufacturing of alcohol is subjected to controlled amounts of water directly and various additives required for soil are combined therewith.

The remainder may be formed from rind and flesh (wine) of grapes, wheat (whiskey, beer), hop (beer), rice (sake), sweet potato (vinegar), buckwheat (low-class distilled spirits) and the like.

Table 1 shows a composition of a culture ground for mushrooms using the above remainder. Controlled amounts of water are utilized in the manufacturing of the culture ground.

TABLE 1

| COMPOSITION OF CULTURE GROUND FOR MUSHROOM | |
|---|---|
| Remainder of Fermentation Material | 80–160 g |
| Wheat Bran | 20–90 g |
| Rice Bran | 10–60 g |
| Bean-Curd Refuse (dry goods) | 20–70 g |
| Water | Controlled to about 65% |

(per cultivation bottle of 850 cc)

The culture ground for mushrooms manufactured above is utilized to cultivate mushrooms (Enokitake, Nameco, Hiratake and the like) by a known cultivation method of the mushroom.

On the other hand, the culture ground for mushrooms after harvest of the mushroom is utilized as artificial soil. The artificial soil is manufactured in combination with at least one or two additives required for soil as shown in Table 2. The combination is implemented in a sterilized room to attain a virus-free environment for manufacturing and the manufacturing is implemented while sterilizing if necessary.

TABLE 2

| COMPOSITION OF ARTIFICIAL SOIL | |
|---|---|
| Culture Ground for Mushroom | 60–80 |
| mycotrophy Fungi | small |
| Husk of Seeds | 5–15 |
| Mineral Component (slag) | 1–3 |
| Charcoal | 5–15 |
| Soil or Sand | 5–30 |

In this case, the additive required for soil contains an additive required to exhibit the physical properties (water-permeable properties), the chemical properties (acidity), microbial properties (clustered fungi: flora) and composite properties thereof required for soil. The additive is sterilized for use to attain virus-free soil.

All of the above additives are not required and necessary additives can be selectively added. Further, additives other than those of Table 2 can be added. The artificial soil as a finished product is subjected to controlled amounts of water and is formed into powder, grain and solid forms.

Further, the artificial soil system may use artificial soil containing as a main component husks of broken seeds instead of the remainder as disclosed in Japanese Unexamined Patent Publication No. 2-46229.

More particularly, since a lot of corncobs or husks of seeds of peaches with the flesh thereof removed are produced in the food industry, such husks of seeds are finely pulverized and utilized instead of the remainder. The husks of seeds may be any other husks of seeds such as walnuts, rice hulls and apricots.

Further, as disclosed in Japanese Unexamined Patent Publication No. 2-46230, artificial soil containing as a main component sawdust instead of the remainder may be used.

More particularly, mushrooms such as the Enokitake are cultivated in culture ground or soil for mushrooms containing as a main component sawdust in a cultivation bottle. When the cultivation of the mushroom is completed, a large quantity of culture soil to be discarded is produced. Such a culture soil to be discarded is effectively used for artificial soil. Virgin sawdust not utilized as the culture soil for mushrooms is used directly. Trees for sawdust may be pine trees, cryptomerias, beeches, oaks, palm trees, gum trees and the like irrespective of broad leaf trees and needle-leaf trees. Further, the sawdust of white birch trees attains a good result.

The upper surface of the artificial soil layer C3 is substantially a planar green G and the ground surface of the artificial soil 4 is lawn ground 10.

As described above, the fundamental artificial ground 1 is constructed.

Further, the artificial ground 1 is provided with a dispersing system 20 for dispersing liquid agricultural chemicals W1.

The dispersing system 20 includes the circular pipe 13 having one end thereof connected to the drainage hole 12 of the sheet member 2 and the other end connected to a dispersing nozzle 22 through a water supply pump 21. The dispersing nozzle 22 includes a plurality of jet orifices capable of dispersing liquid agricultural chemicals W1 or water W2 on the green G and is detachably attached to the circular pipe 13 through a joint 23. On the other hand, a filter 25 is connected through a three-way valve 24 on the circular pipe 13 so that the circular pipe 13 communicates with the drainage side through the filter 25. A supply tank 27 capable of supplying the liquid agricultural chemicals W1 or water W2 is connected through a three-way valve 26 to other position of the circular pipe 13.

Further, an air conditioner 31 is connected to the soil supporting layer C2 through a blast pipe 32 so that warm air or cold air can be supplied to the soil supporting layer C2 if necessary. Further, in a snowy area, poles 33 are provided on the green G and support a cover 34 to construct a dome. Numeral 35 denotes a hole.

The function of the artificial ground 1 provided with the dispersing system 20 is now described.

Since the overlying artificial ground 1 is separated from the underlying natural soil by means of the sheet member 2, penetration of the liquid agricultural chemicals W1 or water W2 into the lower portion of the sheet member 2 can be prevented so that contamination of environment due to the agricultural chemicals W1 can be prevented. Further, penetration of viruses into the upper portion of the sheet member 2 can also be prevented so that the artificial soil 4 can be maintained virus-free for a long time.

On the other hand, when water or liquid agricultural chemicals are dispersed, the three-way valve 26 is switched to connect the supply tank 27 to the circular pipe 13. Further, the water supply pump 21 is operated to supply the liquid agricultural chemicals W1 or water W2 in the supply tank 27 to the dispersing nozzle 22. Thus, the liquid agricultural chemicals W1 or water W2 is dispersed on the green G from the dispersing nozzle 22.

Further, the dispersed liquid agricultural chemicals W1 or water W2 penetrate into the artificial soil layer C3 and pass through the soil supporting layer C2 consisting of the sand and/or charcoal 18, the gravel 17 and the plate material 14 to reach the sheet member 2. Thus, all of the scattered liquid agricultural chemicals 1 or water W2 are collected into the central reservoir space 16 by means of the inclined sheet member 2. In this case, when the three-way valve 24 is switched to supply the liquid agricultural chemicals W1 or water W2 collected in the reservoir space 16 to the filter 25, the liquid agricultural chemicals W1 or water W2 are made harmless and are drained into the drainage side so that contamination of the environment due to the agricultural chemicals is prevented. Further, the collected liquid agricultural chemicals W1 or water W2 can be dispersed from the dispersing nozzle 22 through the circular pipe 13 to save the liquid agricultural chemicals W1 or water W2.

Further, cold air can be supplied from the air conditioner 31 in summer to cool the artificial soil, while warm air can be supplied from the air conditioner 31 in winter to warm the artificial soil.

Figure 2:
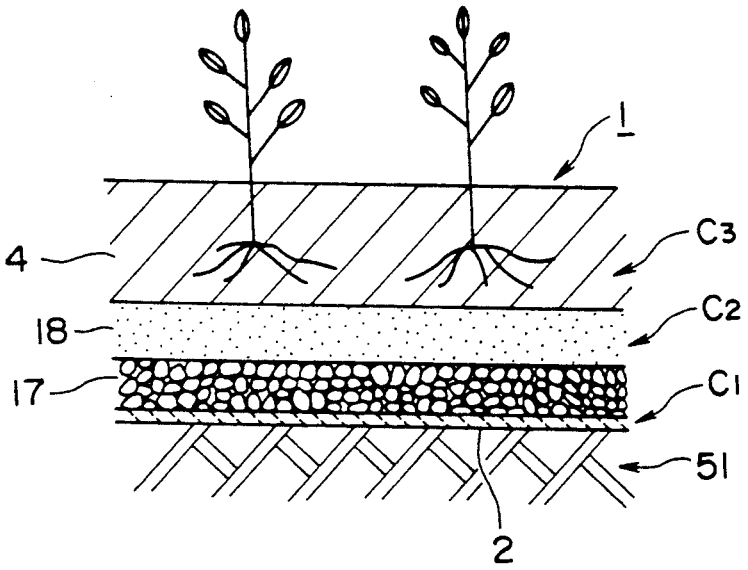
FIG. 2 is a sectional view of artificial ground according to the present invention which is applied to a cultivation system.

An embodiment in which the artificial ground 1 is applied to a usual cultivation system for vegetables, fruits and the like is now described with reference to FIG. 2.

The artificial ground for the cultivation system is fundamentally the same as in the case of the golf course shown in FIG. 1. Numeral 51 denotes an inclined foundation. The foundation includes natural soil unsuitable for cultivation such as barren soil, wet soil and desert, concrete from a rooftop of a building, asphalt of the ground and the like.

The sheet member 2 is spread on the foundation 51 to constitute the collection layer C1. Further, the gravel 17 and the sand 18 are spread on the sheet member 2 to provide the soil supporting layer C2 having water permeability. In addition, the artificial soil layer C3 using the artificial soil 4 is provided on the soil supporting layer C2. Accordingly, the dispersed liquid agricultural chemicals W1 or water W2 are collected by the inclined sheet member 2 and the upper artificial ground 1 is separated from the foundation 51 to maintain a virus-free condition.

In the case of the artificial ground 1 using the artificial soil 4, the growth speed of vegetables and fruits is accelerated remarkably, and the green tea, wasabi or Japanese Horseradish, medicinal carrot and the like which are difficult to cultivate in the usual natural soil can be cultivated. The peripheral facilities including the air conditioner, the dispersing system and the like can be installed in the same manner as the embodiment of FIG. 1.

In the embodiments, the artificial soil is prevented from being steamed in summer and the repeated cultivation can be made only by addition of solutions such as minerals, amino acids and the like.

The embodiments have been described in detail, while the present invention is not limited to such embodiments and modification in a detailed construction, material and application can be made without departing from the gist of the present invention.

We claim:

1. An artificial ground system comprising:

a collection layer including an inclined sheet member capable of collecting liquid agricultural chemicals or water, a soil supporting layer including a water-permeable soil supporting member which is disposed on said collection layer, and an artificial soil layer which includes a culture ground from mushrooms subsequent to mushroom cultivation containing crushed corncobs as its main ingredient in which a Myotrophy fungi is provided after mushrooms are cultivated and which is provided on said soil supporting layer.

2. The artificial ground system according to claim 1, wherein said artificial soil further includes controlled amounts of water and is combined with at least one or two additives required for soil constitution.

3. The artificial ground system according to claim 1, wherein said artificial soil further includes pulverized husks of seeds and is combined with at least one or two additives required for soil constitution.

4. The artificial ground system according to claim 1, wherein said artificial soil further includes sawdust and is combined with at least one or two additives required for soil constitution.

5. The artificial ground system according to claim 1, which further comprises a lawn disposed on said artificial soil layer.

6. The artificial ground system according to claim 3, wherein said pulverized husks of seeds are formed from a member selected from the group consisting of peach pits, walnuts, rice hulls and apricot pits.

7. The artificial ground system according to claim 4, wherein said sawdust is derived from trees selected from the group consisting of pines, cryptomeries, beaches, oaks, palm trees, gum tree, and birches.

8. The artificial ground system according to claim 1, wherein said collection layer comprises a water tight vinyl chloride sheet.

9. The artificial ground system according to claim 1, wherein said soil supporting layer comprises a water-permeable plate member disposed on said collection layer, a gravel layer disposed on said water-permeable plate member, and a sand layer disposed on said gravel layer.

10. The artificial ground system according to claim 1, wherein said soil supporting layer comprises a water-permeable plate member disposed on said collection layer, a gravel layer disposed on said water-permeable plate member, and a sand layer disposed on said gravel layer.

11. The artificial ground system according to claim 1, wherein said artificial soil layer is encompassed by said collection layer and said collection layer inclines from the periphery of said artificial soil layer towards a central portion of said artificial soil layer below said soil supporting layer.

12. An artificial ground system which comprises:

a collection layer including an inclined sheet member capable of collecting liquid agricultural chemicals and water;

a soil supporting layer comprising a water-permeable plate member disposed on said collection layer, a gravel layer disposed on said plate member, and a sand layer disposed on said gravel layer; and an artificial soil layer disposed on said soil supporting layer which comprises artificial soil having as a main component a culture ground from mushrooms subsequent to mushroom cultivation containing crushed corncobs as a main ingredient in which a Myotrophy fungi is provided after mushrooms are cultivated, wherein said collection layer encompasses the periphery of said artificial soil layer and inclines from the periphery thereof towards a central portion below said soil supporting layer.

13. The artificial ground system according to claim 12, wherein said artificial soil layer further includes pulverized husks of seeds formed from a member selected from the group consisting of peach pits, walnuts, rice hulls and apricot pits.

14. The artificial ground system according to claim 12, wherein said artificial soil layer further includes sawdust derived from trees selected from the group consisting of pines, cryptomeries, beaches, oaks, palm trees, gum trees, and birches.

15. The artificial ground system according to claim 1, wherein said collection layer includes a drainage hole at the lowest portion thereof which is operatively connected to a drainage pipe, said drainage pipe being operatively associated with a filter member for filtering drainage material collected in said collection layer so as to form filtered material, and said drainage pipe further being operatively associated with a pump means for pumping said filtered material onto the upper surface of said artificial soil layer through a water dispersing means.

16. The artificial ground system according to claim 12, wherein said collection layer includes a drainage hole at the lowest portion thereof which is operatively connected to a drainage pipe, said drainage pipe being operatively associated with a filter member for filtering drainage material collected in said collection layer so as to form filtered material, and said drainage pipe further being operatively associated with a pump means for pumping said filtered material onto the upper surface of said artificial soil layer through a water dispersing means.

17. The artificial ground system according to claim 15, which further comprises an air conditioning means operatively associated with said collection layer and said soil supporting layer for cooling said artificial soil layer.

18. The artificial ground system according to claim 16, which further comprises an air conditioning means operatively associated with said collection layer and said soil supporting layer for cooling said artificial soil layer.

19. The artificial ground system according to claim 15, which further comprises support poles for attachment along the periphery of said artificial soil layer and a cover for covering said artificial soil layer upon attachment to said support poles.

20. The artificial ground system according to claim 16, which further comprises support poles for attachment along the periphery of said artificial soil layer and a cover for covering said artificial soil layer upon attachment to said support poles.

21. The artificial ground system according to claim 1, wherein said crushed corncobs are in grains of 6 to 60 meshes whereby a larger granular size enhances gas permeability and water permeability of the soil and a smaller granular size is utilized as a soil nutrient.

22. The artificial ground system according to claim 12, wherein said crushed corncobs are in grains of 6 to 60 meshes whereby a larger granular size enhances gas permeability and water permeability of the soil and a smaller granular size is utilized as a soil nutrient.

* * * * *